US005196132A

United States Patent [19]

Mains et al.

[11] Patent Number: 5,196,132

[45] Date of Patent: * Mar. 23, 1993

[54] UNIT-DOSE DRYCLEANING PRODUCT

[75] Inventors: Harold E. Mains; Joseph A. Piepmeyer, both of Montgomery, Ohio

[73] Assignee: Fabritec International Corporation, Cold Springs, Ky.

[ * ] Notice: The portion of the term of this patent subsequent to Oct. 8, 2008 has been disclaimed.

[21] Appl. No.: 678,599

[22] Filed: Apr. 1, 1991

Related U.S. Application Data

[63] Continuation of Ser. No. 318,595, Mar. 3, 1989, Pat. No. 5,055,215.

[51] Int. Cl.[5] ..... C11D 17/08; C11P 17/04

[52] U.S. Cl. ..... 252/90; 252/8.6; 252/92; 252/174; 206/0.5; 206/524.1; 8/142; 220/359

[58] Field of Search ..... 8/142; 252/8.6, 90, 252/92, 174; 206/0.5, 524.1; 220/359

[56] References Cited

U.S. PATENT DOCUMENTS

| | | | |
|---|---|---|---|
| 2,841,572 | 7/1958 | McMahon | 252/90 |
| 2,850,471 | 9/1958 | Klein | 252/90 |
| 3,061,549 | 10/1962 | Dickey | 252/90 |
| 3,198,740 | 8/1965 | Dunlop, Jr. et al. | 252/90 |
| 3,277,009 | 10/1966 | Freifeld et al. | 252/90 |
| 3,413,229 | 11/1968 | Bianco et al. | 252/90 |
| 3,629,140 | 12/1971 | Bayless et al. | 252/90 |
| 3,630,920 | 12/1971 | Freifeld et al. | 252/90 |
| 3,634,260 | 1/1972 | Picking | 252/95 |
| 3,812,042 | 5/1974 | Verdier | 252/90 |
| 3,816,321 | 6/1974 | Kleinschmidt | 252/91 |
| 4,176,079 | 11/1979 | Guerry et al. | 252/90 |
| 4,188,304 | 2/1980 | Clarke et al. | 252/90 |
| 4,234,442 | 11/1980 | Cornelissens | 252/90 |
| 4,286,016 | 8/1981 | Dimond et al. | 252/90 |
| 4,289,815 | 9/1981 | Lee | 252/90 |
| 4,348,293 | 9/1982 | Clarke et al. | 252/90 |
| 4,356,099 | 10/1982 | Davies et al. | 252/90 |
| 4,374,035 | 2/1983 | Bossu | 252/90 |
| 4,410,441 | 10/1983 | Davies et al. | 252/92 |
| 4,416,791 | 11/1983 | Hag | 252/90 |
| 4,513,459 | 4/1985 | Doughty | 252/90 |
| 4,532,063 | 7/1985 | Guledenzopf | 252/90 |
| 4,555,354 | 11/1985 | Clarke et al. | 252/90 |
| 4,557,852 | 12/1985 | Schulz et al. | 252/90 |
| 4,588,080 | 5/1986 | Sinn | 252/90 |
| 4,608,187 | 8/1986 | Chang | 252/90 |
| 4,622,161 | 11/1986 | Cornelissens et al. | 252/90 |
| 4,626,372 | 12/1986 | Kaufmann et al. | 252/90 |
| 4,654,395 | 3/1987 | Schulz et al. | 252/90 |
| 4,659,496 | 4/1987 | Klemm et al. | 252/90 |
| 4,733,774 | 3/1988 | Ping, III et al. | 252/90 |
| 4,741,856 | 5/1988 | Taylor et al. | 252/90 |
| 4,747,976 | 5/1988 | Yang et al. | 252/90 |
| 4,820,435 | 4/1989 | Zafiroghn | 252/90 |
| 5,055,215 | 10/1991 | Mains et al. | 252/90 |
| 5,082,466 | 1/1992 | Rubenstein et al. | 8/142 |

*Primary Examiner*—Paul Lieberman
*Assistant Examiner*—Bradley A. Swope
*Attorney, Agent, or Firm*—Wood, Herron & Evans

[57] ABSTRACT

The present invention is directed to a novel single, unit-dose drycleaning article in which at least a portion thereof dissolves in a drycleaning solvent during the drycleaning cycle for releasing a premeasured amount of a drycleaning additive contained within the article. The single, unit-dose drycleaning article is generally in the form of a sealed tub formed of a polystyrene. The unit-dose tub preferably dissolves within about one minute after being in contact with the drycleaning solvent to ensure release and adequate mixing of the drycleaning additive with the drycleaning solvent to effect maximum drycleaning results. In an alternative form, the single, unit-dose drycleaning article may be partially formed with a material that dissolves in a drycleaning solvent. In that form, it is preferred to locate the single, unit-dose drycleaning article in a sealable enclosure, such as a sealable bag, net or basket, which is formed of a material that is drycleaning solvent-insoluble, drycleaning solvent-permeable, such as a polyethylene, polypropylene, nylon, polyester, cotton, metal, etc., so that the remaining or non-dissolved portion of the single, unit-dose drycleaning article can be retrieved at the end of the drycleaning cycle.

29 Claims, 1 Drawing Sheet

UNIT-DOSE DRYCLEANING PRODUCT

This is a continuation of application Ser. No. 07/318,595, filed Mar. 3, 1989 now U.S. Pat. No. 5,055,215.

FIELD OF THE INVENTION

The present invention relates to a drycleaning article in which at least a portion thereof dissolves in a drycleaning solvent during the drycleaning cycle for releasing a premeasured amount of a drycleaning additive contained within the article and methods of use thereof.

BACKGROUND

The art of drycleaning soiled articles of clothing is old and well established. In the commercial process of drycleaning, soiled garments are agitated in an organic solvent contained in a perforated cylinder to remove oil, grease stains and particles of soil. Typically, small quantities of water and additives are introduced into the organic solvent to help remove water soluble soil, such as sugar and salt stains, to dissipate static charges which build upon the garments as they are tumbled during the drycleaning process and to provide detergency, softening, brightening, etc. According to known practice, the drycleaning solvent is repeatedly recirculated through a filter to remove the soil particles from the organic solvent. This treatment generally lasts from 10 to 30 minutes. After this cleaning phase, the organic solvent is drained from the cylinder and the garments are extracted or spun to remove the bulk of the organic solvent from the wet load. The residual organic solvent and moisture contained by the garments are then removed by passing a current of warm air either through a rotating cylinder containing the garments or, in the case of fragile garments, through a drying cabinet.

Even though the practice of drycleaning soiled garments is well established, the introduction of drycleaning additives into drycleaning machines has long been a problem for the drycleaning industry for many reasons. First, it is standard practice in the industry to introduce the additives including water by hand. The products must be poured or pumped from the bulk shipping containers into a measuring cup. The contents are then transferred to the drycleaning units. Since the additives are introduced into the drycleaning solvents by hand, it is necessary for the drycleaning operators to conduct extensive calculations from recorded data or perform sensitive chemical titration procedures to determine exactly how much additive should be added to ensure effective drycleaning. Unfortunately and all too often during the manual process, such additives are either spilled which is wasteful and messy or added in inconsistent and imprecise amounts due to errors in the calculations or the chemical titration procedures. To help overcome these problems, the drycleaning industry has resorted to elaborate mechanical injection systems. Such systems, however, are not without their drawbacks. They require expensive upkeep and are often inaccurate, i.e., they add too little or too much product.

A second problem associated with introducing drycleaning additives into a drycleaning system is concerned with the viscosities of the drycleaning additives in their concentrated forms. Since drycleaning additives are typically in the form of very viscous liquids or grease, it is necessary to lower their viscosities so that they can be easily injected or poured into the drycleaning units. Most commercial drycleaning additives therefore contain added solvents and chemicals to produce final products that have viscosities which make them more convenient and easy to use by the drycleaning personnel. Unfortunately, the added solvents and chemicals are not without their drawbacks. They are often a hindrance to the cleaning results since they contaminate the drycleaning solvents, serve no cleaning purpose, and often impart undesirable odors to the cleaned and finished garments. Moreover, such solvents and chemicals are toxic to man and/or hazardous to the environment. During the process, the drycleaning personnel are at risk at all times to the toxic effects of such solvents and chemicals due to vapor inhalation and skin and eye contact. Spill hazards are also at risk during the process in view the extensive handling of these products by the drycleaning personnel. To further complicate matters, in some states, the empty bulk containers for these products are considered hazardous waste materials and therefore must be disposed of in accordance with proper procedures.

A further problem associated with such introduction is concerned with the stability of the drycleaning additives. Because drycleaning additives are typically purchased and used in bulk, it is very difficult to protect such drycleaning products from external contamination, oxidation, moisture and the like.

Although attempts have been made in the past to reduce the problems associated with the introduction of drycleaning additives into drycleaning solvents during the cleaning operation, e.g., the installation of mechanical injection devices, to-date these efforts have achieved only limited success for the reasons stated above. It is therefore desirable to provide the drycleaning industry with a clean, unique, reliable and inexpensive method for introducing drycleaning additives into drycleaning solvents in precise and consistent quantities without the above-mentioned disadvantages and drawbacks.

SUMMARY OF THE INVENTION

In brief, the present invention alleviates the above-mentioned problems and shortcomings of the present state of the art through the discovery of a novel drycleaning product and method for delivering a premeasured amount of a drycleaning additive into a drycleaning system during the drycleaning cycle. Broadly speaking, the novel drycleaning product is directed to a drycleaning additive contained within a closed article wherein at least a portion of the closed article is formed of a material which dissolves in the drycleaning solvent during the drycleaning cycle so that the drycleaning additive can be released from the closed article into the drycleaning solvent. More particularly, the closed article of the present invention comprises a hollow container heat sealed with a top which are formed of a thermoplastic polymer, such as a polystyrene, which dissolves in a drycleaning solvent during the drycleaning cycle. The drycleaning additives that may be included within the closed article and contemplated within the scope of the present invention include, but are not limited to, detergents, optical brighteners, antistatic agents, sizing agents, softeners, lubricants and the like as well as any desired mixtures thereof. In addition, water can be included with the drycleaning additive within the closed or sealed article.

In a further feature of the present invention, only a portion of the wall of the closed article need be formed of a material which dissolves when in contact with the drycleaning solvent. When the invention is in this form, it is preferred, but not necessary, to locate the closed article in a sealable enclosure or envelope which is formed of a material that is drycleaning solvent-insoluble, but drycleaning solvent-permeable to permit the drycleaning solvent to enter into the sealable enclosure and dissolve that portion of the closed article that is formed with the drycleaning solvent-soluble material to release the drycleaning additive contained within the closed article. Since the portion of the closed article formed of the insoluble material remains intact, when it is located in the sealable enclosure, it can be easily retrieved via the sealable enclosure at the end of the drycleaning cycle. Moreover, the sealable enclosure can help prevent the undissolved or remaining portion of the closed article from passing through the drycleaning basket and into the pumps used to circulate the solvents within the drycleaning machines. The sealable enclosure of the present invention can be formed of any material and in any shape, such as a sealable bag, net, basket or the like, so long as the material is not soluble in the drycleaning solvent and the sealable enclosure can be made sufficiently permeable to permit the drycleaning solvent to penetrate therein and dissolve the soluble portion of the closed article during the drycleaning cycle. Materials especially suitable for this purpose include a polyethylene, polypropylene, nylon, polyester, cotton, metal, etc., particularly in mesh or screen form.

Thus, the novel drycleaning products and methods of the present invention provide to the drycleaning industry what has been heretofore unavailable. That is, a clean, neat, reliable and inexpensive method for introducing drycleaning additives into drycleaning solvents during the cleaning process. By following the teachings of the present invention, the quantities of drycleaning additives can now be precisely added on a consistent basis without experiencing the drawbacks or disadvantages described hereinabove. That is, the single, unit-dose drycleaning products of the present invention eliminate the prior need for drycleaning personnel to perform complicated calculations and sensitive chemical titrations to determine the proper quantities of products to be added. The additives are premeasured and prepackaged within the novel unit-dose products in advance to ensure consistent delivery of proper amounts of additives to the drycleaning solvents. Moreover, such novel unit-dose products eliminate the need for the use of the toxic and/or hazardous solvents and chemicals that have been required to reduce the viscosities of the drycleaning detergents. With the single, unit-dose drycleaning products of the present invention, the drycleaning additives can be added directly into the unit-dose packages without the use of the viscosity reducing agents, which of course dramatically reduces the cost and weight associated with the use of drycleaning additives. In addition, the undesirable odors normally imparted to the cleaned garments by these viscosity reducing agents can now be avoided. Consequently, the single, unit-dose drycleaning products of the present invention eliminate the human error and the health, environmental, contamination and malodorous problems previously encountered with purchasing and using drycleaning additives in bulk.

The above features and advantages of the present invention will be better understood with reference to the accompanying figures, detailed description and examples. It should also be understood that the drycleaning products and methods of the present invention are exemplary only and not to be regarded as limitations of the invention.

BRIEF DESCRIPTION OF THE FIGURES

Reference is now made to the accompanying figures from which the novel features and advantages of the present invention will be apparent.

DETAILED DESCRIPTION OF THE INVENTION

Figure 1:
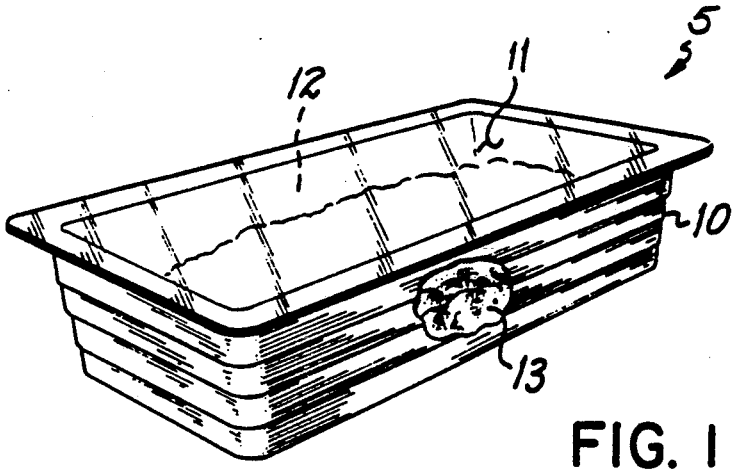
FIG. 1 is a perspective view which is partially in cross-section of a sealed article containing a drycleaning additive of the present invention.

By way of illustrating and providing a more complete appreciation of the present invention and many of the attendant advantages thereof, the following detailed description and examples are given concerning the novel drycleaning products and methods of use thereof.

Referring to the figures, the drycleaning product generally indicated at 5 comprises a rectangular-shaped tub 10 which is formed of a single piece of a thermoplastic polymer heat sealed with a film or top 11 likewise formed of a single piece of a thermoplastic polymer. Within the hollow interior 12 of tub 10 is a premeasured quantity of a selected drycleaning additive 13. Generally speaking, the tub has a volume capacity of approximately 50 ml. or 1.5 fluid oz. Of course, the tub can be formed of other sizes which are well within the contemplation of the present invention.

The tub, as illustrated in FIG. 1 at numeral 10, can be made from high impact polystyrene chips purchased from Huntsman Corporation under product no. 730D. More particularly, the high impact polystyrene chips are formed into polystyrene sheets which, for instance, are dimensioned at 7¼ inches×10 inches and have a thickness of about 15 mils. The tubs 10 are formed from the polystyrene sheets via pressure thermo forming over metal dies. Each finished thermal formed polystyrene sheet contains two rows of five tubs (not shown). The tubs 10 formed in the polystyrene sheets are then filled with the desired drycleaning additives, and heat sealed with a polystyrene film having a thickness of approximately 5 mils. The polystyrene film is a conventional, commercially available clear polystyrene film which can be purchased from the Kama Corporation, Hazeltown, Pa.

Following the heat sealing procedure, the heat sealed tubs are cut into individual tubs via a die cutter, as shown in FIG. 1 at numeral 5. The processes of filling and heat sealing the tubs are straight forward and well known to those versed in the custom packaging field. It should be understood that polystyrene tubs 10 having a thickness of less than about 10 mils will generally produce tubs with thin walls that have a propensity to crack and leak the drycleaning additives sealed therein. On the other hand, it is believed that polystyrene tubs 10 having a thickness of greater than about 20 mils will not readily dissolve in a drycleaning solvent within the drycleaning times normally used in most drycleaning processes, i.e., about 10 to about 30 minutes. Thus, in accordance with the teachings of this invention, it is preferable that tubs 10 have a wall thickness in the range of between about 10 mils to about 20 mils and more preferably about 15 mils. With respect to the thickness of polystyrene top 11, it is preferable that top 11 have a wall thickness in the range from between about 3 mils to about 10 mils and more preferably from between about 5 mils to about 7 mils.

It should be understood that a critical feature of the present invention is that a portion of the material utilized to form the drycleaning product generally indicated at 5 must dissolve within the time of the drycleaning cycle which typically lasts between about 10 minutes to 30 minutes. In a preferred form, however, a portion of such material should dissolve within the drycleaning solvent in less than about 6–7 minutes and more preferably in about 1 minute to ensure proper release and adequate mixing of the drycleaning additive. In addition, it is preferred that the drycleaning product of the present invention should be capable of dissolving in the drycleaning solvent at ambient drycleaning temperatures which are in the range of between about 60° F. to about 105° F. These preferred features unfortunately limit the materials that can be utilized to form the drycleaning product 5. Nevertheless, any material that meets the critical solvency requirement can be utilized, i.e., any material which is capable of dissolving in a drycleaning solvent during the drycleaning cycle. It is found that the most widely commercially available plastics or thermoplastic polymers that meet this solvency requirement are polystyrenes, polystyrene copolymers, foamed polystyrenes and suitable blends thereof. In addition, it is found that such polystyrenes, polystyrene copolymers and foamed polystyrenes may be blended with, for example, other plastics or rubber additives (about 5%), to modify their properties, such as impact resistance, clarity and solubility. It should be appreciated, however, that even though additives may be mixed with the polystyrenes, polystyrene copolymers and foamed polystyrenes to modify their properties, such additives may be mixed only if they do not prevent the drycleaning products from dissolving in the drycleaning solvents during the cleaning cycle.

Figure 3:
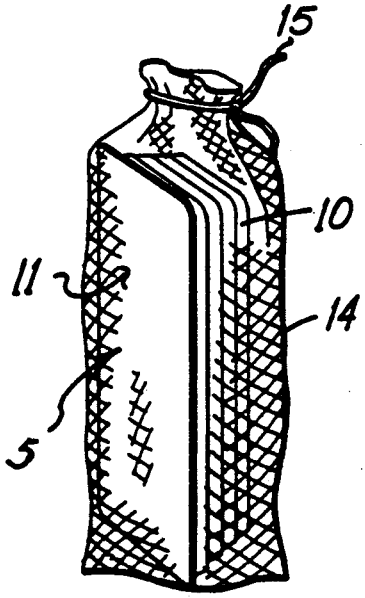
FIG. 3 is a perspective view of an alternative embodiment of the present invention illustrating a sealed article containing a drycleaning additive enclosed within a drycleaning solvent-insoluble drycleaning solvent-permeable enclosure of the present invention.

Although it is preferable to have the entire sealed tub 5 dissolve in the drycleaning solvent, it is not absolutely essential to the purpose of the present invention. For example, tub 10 can be formed of a drycleaning solvent-soluble plastic, i.e., polystyrene, and sealed with a film 11 formed with a drycleaning solvent-insoluble plastic, such as polyethylene, polypropylene or plastic foil composites normally used to seal food stuffs. Likewise, tub 10 may be formed of similar drycleaning solvent-insoluble materials and top or film 11 may be formed of the drycleaning solvent-soluble material. These plastic films or tubs, respectively, would not dissolve in the drycleaning solvent and would be found among the cleaned garments at the end of the cleaning cycle. Since the plastic films or tubs would remain insoluble, it would be necessary to retrieve them to prevent their passing through the basket in the drycleaning washer and into the pumps used to circulate the drycleaning solvents within the drycleaning machines. To circumvent this problem, the partially soluble drycleaning products 5 can be contained in closeable bags 14 and tied with ties 15, as illustrated in FIG. 3, or in other sealable enclosures, such as closeable nets or baskets, that allow the drycleaning solvents to flow through and make contact with drycleaning products 5. The sealable enclosures may of course be sealed by any suitable means, such as with safety pins, zippers, zip-locks, drawstrings, hook-fasteners and the like. At the end of the drycleaning cycle, the undissolved moieties remaining are contained in sealable bags 14 and easily retrieved.

To accomplish this alternate objective, sealable bag 14 or other sealable shapes should be formed of a drycleaning solvent-insoluble, drycleaning solvent-permeable material. Exemplary of such materials are polyethylene, polypropylene, nylon, polyester, cotton, metals and the like. The closure means for the sealable enclosures should also be formed of similar drycleaning solvent-insoluble materials. In this form, it should be understood that bag 14 is formed with a permeability sufficient to enable the drycleaning fluid to effectively penetrate therein and dissolve the soluble portion of drycleaning product 5 during the cleaning cycle so that the drycleaning additive 13 can be effectively released therefrom and into the drycleaning solvent. In addition to bag 14 illustrated in FIG. 3, another example of such a sealable enclosure is a zippered bag (24 inches×30 inches) formed of a nylon netting, which is commonly used by drycleaners to protect sensitive articles during the drycleaning process, including the bag disclosed in copending application, U.S. Ser. No. 07/241,403, filed Sep. 7, 1988, now U.S. Pat. No. 4,989,995, and assigned to the assignee hereof.

With respect to drycleaning additive 13, any commonly used drycleaning detergent can be added to tub 10. These would include cationic, anionic, and non-ionic detergents. Examples of cationic detergents include fatty carboxylic betaines as enumerated in U.S. Pat. Nos. 3,715,186 and 3,635,656, and quarternary ammonium surfactant salts prepared from aliphatic or heterocyclic tertiary amines. The long hydrophobic groups of the betaine or other quarternary nitrogen compounds may be alkyl, alkenyl, alkylaryl, aryl, cycloalkyl, or may contain hetero atoms or hetero groups in the chain. Examples of anionic and non-ionic detergents can also be found in the above patents.

In addition to the drycleaning detergent concentrates, other products can be added into tub 10 for specific purposes. These include, but are not limited to, optical brighteners, thermoplastic sizing products, antistats/softeners, lubricants, etc. It should be recognized, however, that one of the benefits of forming drycleaning product 5 with polystyrene is that such a product automatically provides sizing to the garments being drycleaned once the product is dissolved in the solvent. In addition to the above, water can be added to tub 10 to effect removal of water soluble soils, such as sugar and salt stains.

While the present invention contemplates the introduction of any drycleaning detergent and substance into the tub, it should be understood that only those substances that do not attack the material of which the tub is formed can be added. Thus, organic solvents normally added to drycleaning detergents to reduce their viscosities are not only deleterious to the integrity of the polystyrene tubs and should not be added, they are not necessary. One of the major advantages afforded by the present invention is the elimination of the solvents and chemicals used to reduce viscosities. This is particularly true in view of the fact that the active ingredients in drycleaning detergents normally fall in the range of about 20–80%. As a result, the unit-dose tubs can be filled directly with the drycleaning detergent concentrates in their highly viscous or grease forms. This unique feature provides the drycleaning industry with substantial reductions in cost and weight due to the elimination of the viscosity reducing solvents and chemicals. Moreover, it eliminates the health and environmental concerns associated with their use and permits the drycleaning industry to provide cleaner, non-malodorous garments.

Drycleaning solvents suitable for use with the present invention include chlorinated hydrocarbons such as the perchloroethylenes, i.e., 1–4 carbon 11 atoms, and in particular tetrachloroethyelene and 1,1,1,-trichloroethane, the hydrocarbon solvents such as Stoddard, and the fluorocarbon solvents such as trichlorotrifluoroethane. It should be understood to those skilled in the art that not all materials selected for forming tubs 10 and tops or films 11 will be equally effective in all of the above named solvents. The solubilities of tubs 10 and tops or films will therefore depend upon both the material selected to form same and the drycleaning solvents in which tubs 10 and tops or films 11 will be dissolved.

In use, the drycleaning product 5 is placed on top of a dry load of garments, e.g., 25 pounds, to be drycleaned. The machine is then started and a wash time of approximately 10–30 minutes used. After the wash cycle is complete, the solvent is drained and extracted to a holding tank. When tub 10 and top or film 11 are formed of a polystyrene and a chlorinated hydrocarbon drycleaning solvent is used, tubs 10 and top 11 will be completely dissolved at the end of the cleaning cycle. On the other hand, when tubs 10 and/or top or film 11 are formed of a drycleaning solvent-insoluble material and enclosed in a drycleaning solvent-insoluble, drycleaning solvent-permeable sealable enclosure, the undissolved remaining portion can be easily retrieved via the sealable enclosure. It should of course be appreciated that drycleaning product 5 may be introduced into the drycleaning load at any time during the drycleaning cycle, but it is preferable according to the instant invention to introduce it prior to the start of the drycleaning cycle to ensure that the drycleaning additive will be released into the drycleaning solvent early on to maximize the drycleaning process.

It should be evident by now that the present invention makes possible what was heretofore impossible. That is, the present invention provides to the drycleaning industry a clean, neat, reliable and inexpensive method for consistently introducing precise quantities of drycleaning additives into the drycleaning solvents via single, unit-dose articles. When drycleaning with the drycleaning products and methods in accordance with the present invention, the drawbacks and disadvantages concerning spillage, calculation and titration errors, exposure and contamination are eliminated. The present invention therefore provides to the drycleaning industry a simple, yet effective solution to overcome the long standing problems concerning the introduction of drycleaning additives into drycleaning systems.

Figure 2:
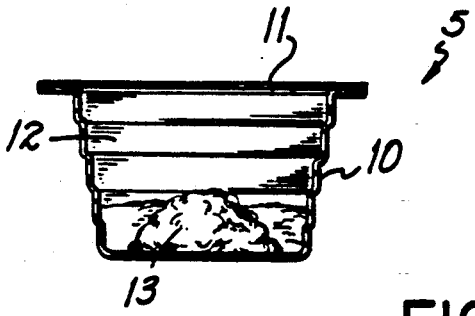
FIG. 2 is a cross-sectional view of an embodiment shown in FIG. 1.

A drycleaning product in accordance with the present invention as illustrated in FIGS. 1 and 2 hereof, will now be further illustrated by reference to the following examples.

Example 1

A conventional Detrex transfer drycleaning machine equipped with cartridge filters was charged with tetrachloroethylene as the drycleaning fluid. The machine capacity was 25 pounds of garments or articles. Twenty-five pounds of garments were introduced into the drycleaning unit. One detergent tub containing 1 oz. of a commcercially available detergent was placed on top of the dry 25 pound load. The machine was started and a wash time of 10 minutes was used.

After the wash cycle was complete the solvent was drained and extracted to a holding tank. The damp garments were transferred to a dryer. This operation was repeated for 10 more loads of soiled garments using one detergent tub for each load or cycle.

The detergency or soil removal effectiveness of the above cleaning method was measured by including with each load of soiled garments a proprietary test towel on which 5-fabric swatches were attached. Two of the soiled swatches employed were a clay impregnated fabric purchased from Scientific Services, Oakland, N.J., and a carbon impregnated fabric purchased from Testfabrics, Inc., Middlesex, N.J. Reflectance measurements with a Photovolt model 575 reflection and gloss meter equipped with a green filter were used to determine the soil removal from the test swatches using the following formula:

$$\text{Detergency} = \frac{Rc - Rs}{Ro - Rs} \times 100$$

where:

Ro=reflectance of original test swatch before soiling.

Rs=reflectance of test swatch after soiling.

Rc=reflectance of test swatch after cleaning. The average detergency for the two soiled swatches as described for the 11 cycles in the foregoing example The average detergency for the two soiled swatches as are tabulated in Table 1.

In addition to the detergency swatches, three plain white unsoiled swatches of wool, cotton, and 65/35 blend of polyester and cotton (PE/Cot) were also attached to the above test towel. The purpose of these swatches was to measure the propensity of the swatches to attract soil released from the soiled garments in the load. This phenomenon is called redeposition. Reflectance measurements were used to measure the amount of soil deposited on the clean swatches via the following formula:

$$\text{Redeposition} = \frac{Ro - Rw}{Ro} \times 100$$

where:

Ro=reflectance of clean original test swatch.

Rw=reflectance of test swatch after cleaning.

The average redeposition for the three swatches for the eleven cycles in the above example are also tabulated in Table 1.

In addition to the two detergency and three redeposition swatches mentioned in the above example, Cleaning Performance Towels (CPT) purchased from the International Fabricare Institute (IFI) of 12251 Tech Road, Silver Spring, Md. 20904, were run in each of the eleven cleaning cycles. The CPT's were added to the cleaning machine with garments and the CPT's underwent the same cleaning process as the garments. The cleaned PTC's were returned to the IFI where the CPT's were evaluated and analyzed by technicians. The IFI CPT's evaluated the following cleaning properties:

% greying, % yellowing, % whiteness, water soluble soil and solid soil removal by measuring the light reflectance of test swatches before and after drycleaning with a reflectometer equipped with blue, amber and green light filters. In summary, % greying, % yellowing, % whiteness measures the pick up of various soils, collectively called redeposition, by white cotton and polyester-cotton swatches. Water soluble soil (food dye, salt) and solid soil removal (rug soil) is determined by measuring via reflectance the removal of food dye and rug soil, respectively, from fabric swatches. The exact methodology used by the IFI to determine the above cleaning properties is proprietary. In general, the rug soil removal and % whiteness are the best indicators of general cleaning efficiency and food dye removal is the best indicator for water soluble soil removal. The results of the eleven cleaning cycles for the IFI CPT's are presented in Table 2.

Example 2

To the same drycleaning unit as described in Example 1 containing tetrachloroethylene solvent was added a conventional commercially available charged-type drycleaning detergent as used in Example 1. The charged-type detergent was added to make a 1% v/v detergent charge in the drycleaning solvent. That is for every 99 gallons of solvent in the drycleaning machine one gallon of the above charged-type detergent was mixed into the solvent.

Twenty-five pounds of garments were introduced into the drycleaning unit. The machine was started and a wash time of 10 minutes was used. After the wash cycle was complete the solvent was drained and extracted to a holding tank. The damp garments were transferred to a dryer. This operation was repeated for 5 more loads of soiled garments. The detergency or soil removal ability of the above cleaning method was determined as described in Example 1. The redeposition properties were also determined as described in Example 1. The results are summarized in Tables 1 and 2.

Example 3

A 35 lb capacity Suprema drycleaning machine designed for tetrachlorethylene solvent was used in this Example. The Suprema machine used in this test is termed a hot dry to dry machine. Hot dry to dry machines clean and dry the garments in the same machine. Thus, soiled garments are loaded, cleaned, dried and the clean garments removed. Hot dry to dry drycleaning machines are advantageous because they conserve expensive solvent since it is not necessary to transfer solvent laden garments to a separate dryer. Solvent evaporates into the air during the transfer The same detergent used in Example 2, namely, the charged-type detergent, was charged to the solvent at a rate of 1 gallon for every 99 gallons of tetrachloroethylene solvent. Two loads of soiled garments (25 & 35 pounds) were cleaned for 10 minutes. One Fabritec and one IFI CP towel was added to each load to determine cleaning performance. After the wash cycle was complete the solvent was drained and extracted to a holding tank and the garments dried. The detergency and redeposition properties were determined as outlined in Example 1. The results are summarized in Tables 1 and 2.

Example 4

The drycleaning equipment used in this Example was the same as used in Example 3. The detergent used in this Example was the same detergent as used in Example 1. The drycleaning machine contained clean tetrachloroethylene solvent. The solvent had been cleaned by distilling dirty solvent and was free from impurities such as soil and previously used detergents. Three separate loads of soiled garments were cleaned in this Example. They are as follows:

| Load | Garment Wgt | Cleaning Time |
|---|---|---|
| 1 | 18 lbs | 8 minutes |
| 2 | 17 lbs | 4 minutes |
| 3 | 10 lbs | 10 minutes |

Each of the leads was cleaned in the presence of one Fabritec and one IFI CP Towel. The towels were added to the loads to determine cleaning performance as outlined in Example 1. In this Example, the procedure involved adding the garments to the machine with one tub or container containing 1 oz. of the detergent referred to in Example 1. The three loads were cleaned as listed above. After the cleaning cycle, the solvent was drained and extracted to a holding tank and the garments dried. The detergency and redeposition performance of the three loads were determined as described in Example 1. The results are summarized in Tables 1 and 2.

Example 5

In this example a 40 pound machine, a hot dry to dry unit, was charged with tetrachloroethylene solvent and was equipped with cartridge filters. A commercially available injection detergent was used. The injection detergent was a commercially available no-charge cationic detergent that was added to each load of garments at the rate of 1/5 oz per pound in the load. The injection detergent was injected into the wash wheel of the drycleaning unit via an electromechanical device. In this Example, a 35-pound load of soiled garments was cleaned, thus, 7 oz of the injection detergent was injected into the machine at the start of a one bath, 10 minute cleaning cycle. After the cleaning cycle was completed, the solvent was drained to a holding tank and the drying cycle completed. The soiled garments were cleaned in the presence of one Fabritec and one IFI CP Towel. The towels were added to the load to determine the cleaning performance as outlined in Example 1. The results of the cleaning tests are shown in Tables 1 and 2.

Example 6

The same equipment was used in this Example as was used in Example 5. The detergent used in this Example was the same detergent as used in Examples 1 and 4. In this Example, two loads (35 & 40 lbs) of soiled garments were processed. In each load, one Fabritec and one IFI CP Towel were added to determine the cleaning performances of the two loads as in Example 1. To each load, two detergent tubs were added after the garments were loaded into the drycleaning unit. Each of the loads was cleaned in a bath of solvent for 10 minutes after which the solvent was drained from the garments and the wet garments dried in the machine. The results from the two cleaning performance towels are summarized in Tables 1 and 2.

In the above Examples, the tubs dissolved during the cleaning cycles. These cleaning cycles ranged, in the Examples, from a duration of 4 minutes to 10 minutes and are typical of the cleaning times employed by most drycleaners today who clean with tetrachloroethylene solvent. Visual examination of the dry garments after cleaning showed no trace of undissolved tub moieties. No traces of the polystyrene tub receptacle could be found nor any staining of the garments was noted from the concentrated detergent contained within the sealed tubs.

In addition to Examples 1–6, several drycleaning experiments were also carried out in which white garments were wrapped around tubs and fastened in place with safety pins. The pins prevented the tubs from moving freely in the drycleaning machine and also marked which garments contained the tubs and the location of the tubs. After the loads were cleaned the pinned garments were examined visually for any evidence of undissolved tub residues. None were found. In one experiment, the detergent sealed in the tub was the injection detergent referred to in Example 5. This injection detergent further included a colored dye in the formulation to impart a colored appearance to the detergent. The purpose of the dye was to give the product visual identification. No dye staining from these detergent tubs was found on any of the white garments to which the tubs were bound.

TABLE 1

| Example | Fabritec Test Towel Results: ave. % detergency Clay | Carbon | ave. % redeposition* Wool | Cotton | PE/Cot | Cycles | Detergent |
|---|---|---|---|---|---|---|---|
| 1 | 34.9 | 31.6 | −0.1 | 1.3 | −1.8 | 11 | 1 Tub (detergent) |
| 2 | 33.0 | 27.4 | 0.1 | 0.9 | −1.7 | 6 | 1% Charged-type detergent |
| 3 | 46.9 | 40.7 | −4.9 | −1.5 | −5.8 | 2 | 1% Charged-type detergent |
| 4 | 44.6 | 40.7 | −1.0 | −1.1 | −3.6 | 3 | 1 Tub (detergent) |
| 5 | 36.6 | 24.9 | 4.1 | 0.9 | −1.5 | 1 | Injection detergent |
| 6 | 36.0 | 37.4 | −0.5 | −0.6 | −1.6 | 2 | 2 Tubs (detergent) |

*A negative value in the redeposition data means the swatch is cleaner, i.e., it reflects more light after than it did before cleaning.

TABLE 2

| Ex. | IFI CPT RESULTS Detergency % Greying PE/Cot | Cot | % Yellowing PE/Cot | Cot | % Whiteness PE/Cot | Cot | Water Soluble Soil % Salt | % Dye | Insoluble Soil % Rug Soil | Cycles | Detergent |
|---|---|---|---|---|---|---|---|---|---|---|---|
| 1 | 7.2 | 8.1 | 2.4 | −2.1 | 82.5 | 77.1 | 27.0 | 27.5 | 81.4 | 11 | 1 Tub (detergent) |
| 2 | 6.6 | 7.4 | 3.9 | −2.3 | 81.3 | 75.0 | 26.3 | 29.8 | 83.7 | 6 | 1% Charged-type detergent |
| 3 | 4.3 | 4.2 | 0.7 | 0.6 | 94.3 | 92.1 | 22.0 | 25.5 | 90.0 | 2 | 1% Charged-type detergent |
| 4 | 3.7 | 3.6 | 0.4 | −3.7 | 95.5 | 93.8 | 26.3 | 31.3 | 92.0 | 3 | 1 Tub (detergent) |
| 5 | 4.6 | 5.7 | 0.4 | 0.2 | 94.9 | 92.3 | 22.0 | 66.0 | 77.0 | 1 | Injection detergent |
| 6 | 4.3 | 4.9 | 0.4 | −0.5 | 95.3 | 91.9 | 22.0 | 26.0 | 81.0 | 2 | 2 Tubs (detergent) |

The results from the Examples summarized in Tables 1 and 2 show the detergent tubs of the present invention produced cleaning results comparable to presently used detergents and cleaning methods as practiced by drycleaners today.

The present invention may, of course, be carried out in other specific ways than those herein set forth without departing from the spirit and essential characteristics of the present invention. For example, while it is preferred to heat seal tub 10 with top or film 11, it is also contemplated within the scope of the present invention that top or film 11 may be secured to tub 10 via any suitable drycleaning solvent-soluble adhesive, such as a hot melt adhesive, a polyamide adhesive, a polyester adhesive and a pressure-sensitive adhesive, especially when tub 10 and top or film 11 are both formed with a drycleaning solvent-insoluble material. On the other hand, when either tub 10 or top or film 11 is formed with a drycleaning solvent-soluble material, top or film 11 may be secured to tub 10 via a drycleaning solvent-insoluble adhesive. Likewise, the present invention contemplates securing top or film 11 to tub 10 via solvents, such as chlorinated hydrocarbon solvents such as the perchloroethylenes, perchloroethanes, carbon tertachloride and the like. Securing articles formed with thermoplastic polymers via solvents is straight forward and well known to those versed in the bonding art. The present embodiments are, therefore, to be considered in all respects as illustrative and not restrictive and any changes coming within the meaning and equivalency range of the appended claims are to be embraced therein.

Having described our invention, we claim:

1. A unit-dose drycleaning product comprising at least one drycleaning additive contained within a sealed water insoluble article wherein at least a portion of said sealed water insoluble article is comprised of a material which dissolves in a drycleaning solvent during the drycleaning cycle for releasing said drycleaning additive.

2. A unit-dose drycleaning product of claim 1 wherein the material is a polystyrene thermoplastic polymer.

3. A unit-dose drycleaning product of claim 1 wherein the material is selected from the group consisting of a polystyrene, a modified polystyrene, a foamed polystyrene, a polystyrene copolymer, a modified polystyrene, a modified polystyrene copolymer, a modified foamed polystyrene and mixtures thereof.

4. A unit-dose drycleaning product of claim 1 wherein said sealed water insoluble article comprises a hollow container sealed with a top, the container having a wall thickness of between about 10 mils to about 20 mils, the top having a thickness of between about 3 mils to about 10 mils.

5. A unit-dose drycleaning product of claim 4 wherein at least a portion of said top dissolves in a drycleaning solvent.

6. A unit-dose drycleaning product of claim 4 wherein at least a portion of said container dissolves in a drycleaning sovlent.

7. A unit-dose drycleaning product of claim 1 wherein said drycleaning additive is selected from the group consisting of a detergent, an optical brightner, a sizing agent, an antistatic agent, a softener, a lubricant and mixtures thereof.

8. A unit-dose drycleaning product of claim 7 wherein said sealed water insoluble article further includes water.

9. A unit-dose drycleaning product of claim 1 wherein the drycleaning solvent is selected from the group consisting of a hydrocarbon solvent, a chlorinated hydrocarbon solvent and a fluorocarbon solvent.

10. A unit-dose drycleaning product of claim 9 wherein the chlorinated hydrocarbon solvent is selected from the group consisting of a perchloroethylene and 1,1,1-trichloroethane.

11. A unit-dose drycleaning product of claim 4 wherein the top is heat-sealed to the container.

12. A unit-dose drycleaning product of claim 4 wherein the top is secured to the container via an adhesive which is soluble in the drycleaning solvent.

13. A unit-dose drycleaning product of claim 4 wherein the top is secured to the container via a solvent which is soluble in the drycleaning solvent.

14. A unit-dose drycleaning product of claim 1 wherein said unit-dose drycleaning product further includes a sealable enclosure formed with a drycleaning solvent-insoluble, drycleaning solvent-permeable material, said sealable enclosure containing therein said sealed water insoluble article and being sufficiently permeable to the drycleaning solvent so that during the drycleaning cycle the drycleaning solvent penetrates into said sealable enclosure and dissolves the portion of said material which is soluble in the drycleaning solvent for releasing said drycleaning additive from said sealed water insoluble article.

15. A unit-dose drycleaning product of claim 1 wherein said sealed article comprises a hollow container sealed with a top, said container and said top being formed with a drycleaning solvent-insoluble material and secured to one another via a drycleaning solvent-soluble substance selected from the group consisting of an adhesive and a solvent.

16. A unit-dose drycleaning product of claim 1 wherein said sealed water insoluble article comprises a hollow container sealed with a top, either said container or said top being formed with a drycleaning solvent-soluble material, the other being formed with a drycleaning solvent-insoluble material, said container and said top being secured to one another via a drycleaning solvent-insoluble or drycleaning solvent-soluble substance selected from the group consisting of an adhesive and a solvent.

17. A unit-dose drycleaning product of claim 1 wherein said drycleaning additive is a detergent in a concentrated form substantially free of a viscosity reducing agent.

18. A unit-dose drycleaning product for delivering a premeasured amount of a drycleaning additive into a drycleaning system during the drycleaning cycle, said unit-dose drycleaning product comprises:

a premeasured amount of a least one drycleaning additive; and a sealed water insoluble article having a wall defining a hollow interior which contains said drycleaning additive wherein at least a portion of said wall is formed of a material which dissolves in a drycleaning solvent during the drycleaning cycle for releasing said drycleaning additive.

19. A unit-dose drycleaning product of claim 18 wherein said unit-dose drycleaning product further includes a sealable enclosure formed with a drycleaning solvent-insoluble, drycleaning solvent-permeable material, said sealable enclosure containing therein said sealed water insoluble article and being sufficiently permeable to the drycleaning solvent so that during the drycleaning cycle the drycleaning solvent penetrates into said sealable enclosure and dissolves the portion of said wall which is soluble in the drycleaning solvent for releasing said drycleaning additive from said sealed water insoluble article.

20. A unit-dose drycleaning product of claim 18, said sealed water insoluble article comprises a hollow container sealed with a top, said container includes said wall wherein said material is a thermoplastic polymer, said top is comprised of a drycleaning solvent-insoluble material.

21. A unit-dose drycleaning product of claim 20 wherein the thermoplastic polymer is selected from the group consisting of a polystyrene, a modified polystyrene, a foamed polystyrene, a polystyrene copolymer, a modified polystyrene a modified polystyrene copolymer, a modified foamed polystyrene and mixtures thereof.

22. A unit-dose drycleaning product of claim 20 wherein the drycleaning solvent-insoluble material is selected from the group consisting of a polyethylene, a polypropylene and a plastic foil.

23. A unit-dose drycleaning product of claim 18, said sealed water insoluble article comprises a hollow container sealed with a top, said container is comprised of a drycleaning solvent-insoluble material, said top includes said wall wherein said material is a thermoplastic polymer.

24. A unit-dose drycleaning product of claim 23 wherein the thermoplastic polymer is selected from the group consisting of a polystyrene, a modified polystyrene, a foamed polystyrene, a polystyrene copolymer, a modified polystyrene, a modified polystyrene copolymer, a modified foamed polystyrene and mixtures thereof.

25. A unit-dose drycleaning product of claim 23 wherein the drycleaning solvent-insoluble material is selected from the group consisting of a polyethylene, a polypropylene and a plastic foil.

26. A unit-dose drycleaning product of claim 18 wherein said drycleaning additive is selected from the group consisting of a detergent, an optical brightner, a sizing agent, an antistatic agent, a softener, a lubricant and mixtures thereof.

27. A unit-dose drycleaning product of claim 26 wherein said sealed water insoluble article further includes water.

28. A unit-dose drycleaning product of claim 18 wherein the drycleaning solvent is selected from the group consisting of a hydrocarbon solvent, a chlorinated hydrocarbon solvent and a fluorocarbon solvent.

29. A unit-dose drycleaning product of claim 18 wherein said drycleaning additive is a detergent in a concentrated form substantially free of a viscosity reducing agent.

* * * * *

UNITED STATES PATENT AND TRADEMARK OFFICE

CERTIFICATE OF CORRECTION

PATENT NO. : 5,196,132

DATED : March 23, 1993

INVENTOR(S) : Harold E. Mains and Joseph A. Piepmeyer

It is certified that error appears in the above-indentified patent and that said Letters Patent is hereby corrected as shown below:

Column 8, lines 35-37, " . . . example. The average detergency for the two soiled swatches as are tabulated in Table 1." should read -- example are tabulated in Table 1.--.

Column 14, line 1, "of a least" should read --of at least--.

UNITED STATES PATENT AND TRADEMARK OFFICE

CERTIFICATE OF CORRECTION

PATENT NO. : 5,196,132

DATED : March 23, 1993

INVENTOR(S) : Harold E. Mains adn Joseph A. Piepmeyer

It is certified that error appears in the above-indentified patent and that said Letters Patent is hereby corrected as shown below:

Column 14, line 30, "modified polystyrene a modified polystyrene copolymer" should read --modified polystyrene, a modified polystyrene copolymer--.

Signed and Sealed this

Twelfth Day of April, 1994

Bruce Lehman

*Attest:*

BRUCE LEHMAN

*Commissioner of Patents and Trademarks*

*Attesting Officer*